US005588919A

United States Patent [19]

Nakamura

[11] Patent Number: 5,588,919

[45] Date of Patent: Dec. 31, 1996

[54] GOLF SWING TRAINING DEVICE

[76] Inventor: Yoshikazu Nakamura, 4-25, Kamigasa 1-Chome, Kusatsu-shi, Shiga 525, Japan

[21] Appl. No.: 503,242

[22] Filed: Jul. 17, 1995

[30] Foreign Application Priority Data

Aug. 2, 1994 [JP] Japan ..... 6-201418
Oct. 23, 1994 [JP] Japan ..... 6-284485

[51] Int. Cl.[6] ..... A63B 69/36

[52] U.S. Cl. ..... 473/212; 473/224

[58] Field of Search ..... 273/187.2; 473/212, 473/213, 214, 215, 216, 224, 223

[56] References Cited

U.S. PATENT DOCUMENTS

| | | | |
|---|---|---|---|
| 1,703,375 | 2/1929 | Volk | 273/188 R |
| 2,064,603 | 12/1936 | Harrison | 273/187.2 X |
| 3,860,245 | 1/1975 | Yamada | 273/187.2 |
| 4,059,267 | 11/1977 | Noble | 273/187.2 |
| 5,372,365 | 12/1994 | McTeigue | 273/187.2 |
| 5,423,547 | 6/1995 | Puso | 273/187.2 |

*Primary Examiner*—George J. Marlo
*Attorney, Agent, or Firm*—Armstrong, Westerman, Hattori, McLeland & Naughton

[57] ABSTRACT

A golf swing training device actuated by golf club back swing and down swing by the golfer and comprising arm angle detecting means which includes a support member mounted on a golfer's arm for movement therewith as the golfer makes a swing, a direction indicator mounted on the support member and for indicating a direction in a plane including the gravitational direction or a direction at a fixed angle to the gravitational direction, and a direction indicator detecting means for detecting the direction indicator when an angular position set as desired with respect to the direction indicator is reached by the support member, and a means for informing the golfer of the arm angle detected by the arm angle detecting means through the controller. The informing means including means for initiating a signal and transmitting such signal to the golfer or knee, waist and/or ankle of the golfer for causing slight twisting of the golfer's body in a down-swing start direction and starting down swing.

17 Claims, 6 Drawing Sheets

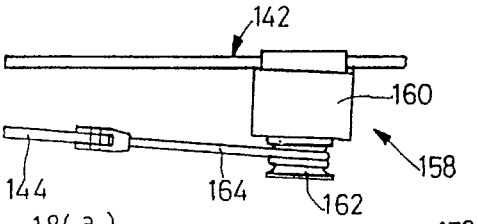
Fig.18( a )
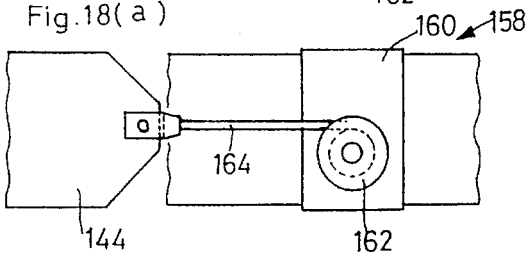
Fig.18( b )
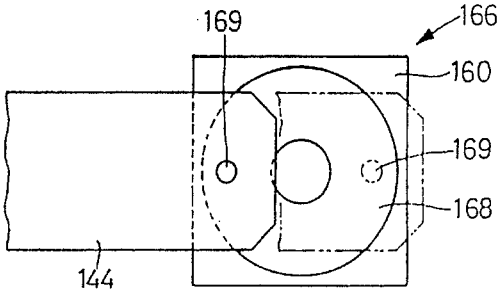
Fig.19
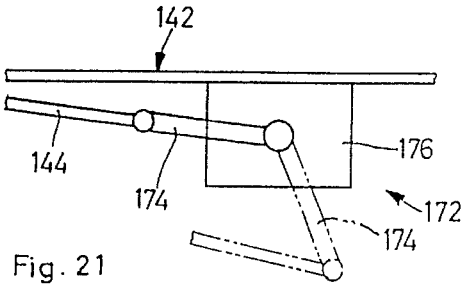
Fig. 21
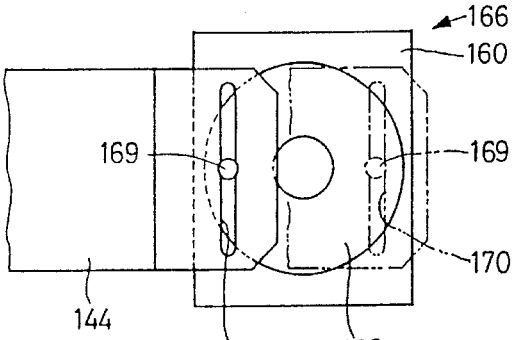
Fig. 20
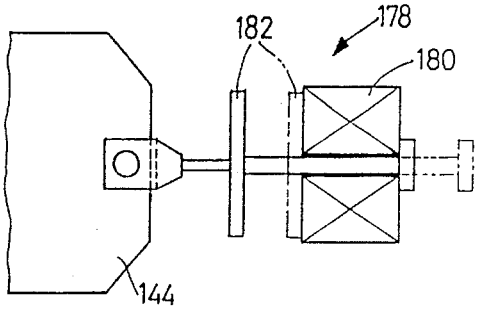
Fig. 22
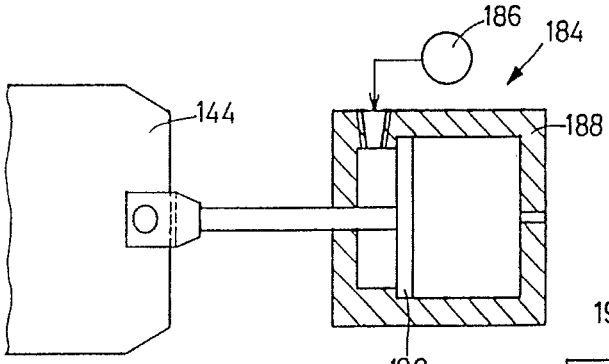
Fig. 23
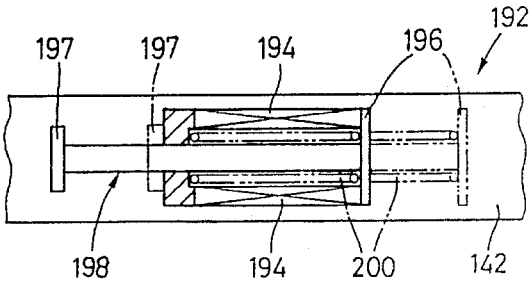
Fig. 24

GOLF SWING TRAINING DEVICE

BACKGROUND OF THE INVENTION

This invention relates to golf swing training devices, and more particularly, to a golf swing training device, with which a golf swing technique is to be acquired by people aiming at single figure level handicap or persons who want to be professional golfers.

There is a slight difference in golf swing techniques between instructors. It is said that there are 100 or more (or 500 or more) swing check points. However, when these check points are arranged and classified, they are reduced to several basic check points. Examples of such basic check points are to correctly grip the club and take a correct stance, not to make a head-up, not to move the head, not to open the armpits, not to impact the ball by using the hands or arms from the top, i.e., make a swing by twisting the body about the backbone by using muscles of the body, that is, taking a right hand golfer as an example, shift the weight from the right foot to the left foot, etc.

While there are a large number of golf swing check points as noted above, it is impossible to make a swing while checking all these points in a short swing time of 1 to 1.5 seconds. However, by mastering check points which are thought to be most important, ideal movements are acquired to obtain naturally good movements which satisfy most of other check points as well.

These check points have to be mastered as a basic technique. However, it is impossible to visually confirm the swing form. Therefore, the swing form is liable to be deviated to result in high scores. Further, even when the person has become able to swing the golf club after mastering the above check points, he or she may not be able to provide a sufficient distance in a long hole or may produce a misshot so that he or she can not improve the score. Particularly, woman golfers and like persons who are not so tall or persons who do not have much muscles can not produce long distance. Inevitably, they try to increase the distance and therefore forget making proper golf swing. For instance, they often swing the golf club with their arms or hands from the top, thus resulting in misshots or swing form deviation and making golf play more difficult.

In order that even a person who is not so tall and does not have much physical power be able to hit the ball for a long distance by increasing the head speed, make a high level golf swing to cause the ball to fly along a steady orbit and maintain handicap between zero and single figure, the inventor has endeavored to improve the golfer's own swing form, studied by comparing the swing forms of famous home and foreign professional golfers and by comparing methods of improving golf play recommended by professional golfers.

As a result, the inventor has found that the methods of improving golf play recommended by the professional golfers involve what are thought to be secret as know-how. But as a result of detailed analyses of video tapes and continuous pictures showing swing forms of professional golfers, it has been found that there substantially is a common swing. The content of the swing is that at the turn-over from the top the upper and lower bodies are moving in opposite directions concurrently although for a very short period of time. This golf swing has been exercised repeatedly, and extremely good results have been obtained with stability of the swing form.

The golf swing found by the inventor will now be described in greater detail. A right hand golfer will be taken as an example. First, when the golfer gets into the back swing form the address, the body is twisted clockwise about the backbone. When the golfer's left shoulder is brought into contact with the left side of the chin, that is, at a 80 to 90% back swing position or slightly before the top, the golfer intuitively begins to cause simultaneous sliding of the left knee and the left waist by several centimeters for down-swinging. As a result, a time difference is produced, and the lower body turns to be rotated counterclockwise while effecting a sliding for several centimeters toward the target, while the upper body continues to be rotated clockwise due to the momentum toward the top position. Thus, for a very short moment the upper and lower bodies are moved in the opposite directions so that the body is twisted greatly, and the upper body being rotated clockwise is pulled with the lead of the lower body, and as a result, the shaft bows at the top and the body turns to be rotated counterclockwise with the body muscles as a spring and under the principles of twisting and lever, thus getting into the down swing. The down swing is brought about from the body turn swing with the body muscles with the lead of the lower body. A high head speed thus can be obtained for ball impact. When the golfer subsequently gets into the follow-through, if the state of contact between the right shoulder and the right side of the chin with each other can be confirmed, it means that a good swing without head-up could be obtained.

As shown above, an ideal and desirable golf swing is a commonly termed down swing with the lead of the lower body, in which the golfer, having gotten into the back swing from the address and reaching the top, turns to go to a down swing by twisting the lower body, i.e., waist and legs, in the direction of the down swing. If the golfer can make such a down swing with the lead of the lower body, a good swing, and hence a good shot, can be obtained. However, most of the golfer's misshots stem from a commonly termed hand swing, i.e., down swing with the lead of the upper body in the turn-over from the top.

A down swing with the lead of the lower body can be realized by intuitive play of the golfer himself or herself. In many actual cases, however, the golfer can not recognize by himself or herself whether he or she is in the state of down swing with the lead of the lower body or the state of hand swing. Therefore, it is inevitable to let an adviser watch the swing form and receive advices. However, it is impossible to receive advices from an adviser at all times.

Accordingly, researches and investigations have been conducted about the method of making hand swing difficult and permitting stable down swing with the lead of the lower body. As a result, it has been found that as the back swing is gradually accelerated toward the top to produce a maximum speed near the top, that is, by increasing the momentum toward the top, the shaft flexes to make it difficult to use the hands or arms, thus permitting the ideal swing with the lead of the lower body while it is tried to make a hand swing. The inventor has conducted extensive researches and investigations with an aim of permitting one to master such a golf swing and, as a result, has succeeded in providing a golf swing training device according to the invention. Professional golfers say that 80% of whether a shot is good or not is determined by back swing. However, there is no one who says such know-how or secret as what back swing is effective for obtaining the golf club shaft flexing at the top. Further, there is no one who says that such a swing permits maximum merits to be obtained.

Accordingly, the inventor has conducted extensive researches and investigations with an aim of permitting one to master such an ideal golf swing and, as a result, provided Patent Application No. Heisei 5-51430 and Patent Application No. Heisei 5-347842 before. The inventor has experimented in putting trial products on monitors such as professional golfers and golf trainees, and found that considerable effect can be obtained. However, down swing start timing differs individually, in other words, the flexibility of body of a golfer and the habit of a golfer differ individually. In addition, reacting speed against stimuli from outside such as sound, vibration, etc. differs individually. Therefore, the inventor has further conducted extensive researches and investigations, and succeeded in providing a golf swing training device according to the invention. Prior to the filing of the present application, the inventor has made a survey of prior arts using a computer, but could not find out any invention which seemed to appertain the present invention.

BRIEF SUMMARY

A golf swing training device comprising arm angle detecting means mounted on a golfer's arm for movement therewith as the golfer makes a swing, thereby detecting the angle of the arm, and informing means for informing the golfer of the arm angle detected by the arm angle detecting means.

The golf swing training device, wherein the arm angle detecting means includes a direction indicator mounted on the golfer's arm and for indicating a predetermined absolute axis direction, and direction indicator detecting means for detecting the direction indicator upon reaching of an angular position set as desired with respect to the direction indicator.

The golf swing training device, wherein the arm angle detecting means includes a support member mounted on the golfer's arm for movement therewith as the golfer makes a swing, a direction indicator mounted on the support member and for indicating a direction in a plane including the gravitational direction or a direction at a fixed angle to the afore-mentioned direction, and direction indicator detecting means for detecting the direction indicator when an angular position set as desired with respect to the direction indicator is reached by the support member.

The golf swing training device, wherein the arm angle detecting means includes a support member mounted on the golfer's arm for movement therewith as the golfer makes a swing, a rotatable member mounted rotatably on the support member and capable of being fixed at an angular position set as desired, a direction indicator capable of being moved along a guide provided on the rotatable member to a position corresponding to minimum potential energy, and direction indicator detecting means provided on the guide of the rotatable member and for detecting the direction indicator when an angular position set as desired is reached by the support member.

The golf swing training device, wherein the arm angle detecting means includes a support member mounted on the golfer's arm for movement therewith as the golfer makes a swing, a direction indicator for indicating a horizontal direction at all times, and a direction indicator detecting means for detecting the direction indicator when an angular position set as desired with respect to the direction indicator is reached by the support member.

The golf swing training device, wherein the informing means for selectively informing the golfer by the speech of instructions of operation, such as "Start from the lower half of body.", "Start from the waist.", "Start from the knee.", "Start from the leg.", "Do not move the axis.", "Do not hasten to hit the ball.", "Do not move the head.", "Just meet.", etc.

The golf swing training device, wherein the informing means includes start timing transmitting means provided on the knee and/or the waist on the side of the support foot after body weight shift.

The golf swing training device, wherein the informing means is a down-swing start instructor provided on a portion of clothing or belt worn by the golfer and for forcibly causing a slight twisting of a portion of the golfer's body in a down-swing start direction or giving a shock on the golfer's body.

The golf swing training device, wherein the direction indicator detecting means of the arm angle detecting means is set such as to detect a golfer's arm angle corresponding to the top position or a position slightly before reaching the top position in the back-swing, the informing means informing the golfer of an instruction to start the down-swing from the lower half of the body when the afore-mentioned position is detected.

The golf swing training device, wherein the arm angle detecting means is set such as to detect an angle set as desired during the back-swing from the address to the top position, the top angle position being determined or the approach swing being started according to an instruction from the informing means when the afore-mentioned angle is detected as a fixed angle.

A golf swing training device comprising a down-swing start instructor including a flexible member mounted on a portion of clothing or belt worn by the golfer and for forcibly causing a slight twisting of a portion of the golfer's body in a down-swing start direction and a driver for causing a slight movement of the flexible member in the down-swing start direction, position detecting means mounted on a portion of the golfer's body or on a portion of the club and for detecting a down-swing start position; and a controller for transmitting a detection signal from the position detecting means to the down-swing start instructor.

A golf swing training device having a construction capable of informing the golfer by speech from an earphone or a small-size loudspeaker provided in the neighborhood of a golfer's ear of specific basic operation of and/or points to be noted for the golf swing.

The arm angle detecting means of the golf swing training apparatus according to the invention, includes the direction indicator mounted on a golfer's arm and the direction indicator detecting means for detecting the direction indicator. The direction indicator indicates, as a reference direction, a predetermined absolute axis direction, i.e., the gravitational direction, a horizontal direction, the glove axis direction, etc., or a direction at a fixed angle to such direction. Thus, by detecting an angle with respect to the direction indicator, the golfer's arm angle can be detected stably at all times. It is thus possible to construct various types of golf swing training device by using the arm angle detecting means.

The golf swing training device according to the invention comprises at least the arm angle detecting means for detecting the reaching of a predetermined angle of the golfer's arm, and the informing means for informing the golfer of the detection. The arm angle detecting means is mounted on a portion, for instance an upper portion of the golfer's arm. Particularly, the arm angle detecting means is constructed such that, while the support member is rotated together with the golfer's arm, the direction indicator mounted on the support member indicates the absolute axis direction, i.e., the gravitational direction, a direction in a plane of the gravitational direction or a direction at a fixed angle with respect to such direction, independently of the angle of the support member. Thus, once the fixed position of the direction indicator detecting means is set adequately, when the direction indicator is detected by the direction indicator detecting means as a result of the rotation of the support member together with the golfer's arm, the golfer is informed of the detection by a detection signal from the informing means, so that he or she can know that his or her arm is at a predetermined angular position.

In a different structure of arm angle detecting means, the rotatable member is mounted rotatably on the support member, and the direction indicator detecting means is adapted to detect the direction indicator when the direction indicator is moved along the guide on the rotatable member to the minimum position energy position. The rotatable member is thus held rotated relative to the support member such that the direction indicator moved to the minimum energy position is detected when the support member rotated together with the golfer's arm is brought to a position of a predetermined arm angle. Thus, when the direction indicator is detected by the direction indicator detecting means as the support member is rotated together with the golfer's arm, the golfer is informed of the detection by a detection signal from the informing means so that he or she can know that his or her arm is at a predetermined angular position.

In a further structure of arm angle detecting means, the direction indicator is adapted to indicate a horizontal direction at all times independently of the angle of the support member, and the direction indicator detecting means is adapted to detect the direction indicator when the support member is brought to a position of a predetermined angle with respect to the direction indicator. This structure has the same function as described above.

In the golf swing training device according to the invention, as the informing means may be used one which is adapted to inform the golfer by the speech of the content of a detection signal from detecting means via the controller. The golfer thus can be informed by the informing means of the down-swing start timing. For example, the informing means may be constructed such as to selectively inform the golfer by the speech of instructions of operation, such as "Start from the lower half of body", "Start from the waist", "Start from the knee", "Start from the leg", "Do not move the axis", "Do not hasten to hit the ball", "Do not move the head", "just meet", etc. With such a structure, the golfer can always take knowledge of what is to be done and thus can make a stable down-swing led by the lower half of the body.

Further, in such a golf swing training device, the informing means may include timing transmitting means for transmitting the timing of sliding and turning the waist and/or the knee in the flying direction of the ball to start a down-swing after a back-swing. The golfer thus can sense the down-swing start timing and make the above operation more perfect.

Further, the informing means used for the golf swing training device according to the invention suitably includes the down-swing start instructor for forcibly causing a slight twisting of a portion of the golfer's body in a down-swing start direction or giving a shock on the golfer's body. Such a down-swing start instructor may be constructed with the flexible member and the driver therefor. The flexible member has one end attached to a portion of the clothing or belt worn by the golfer, an intermediate portion wound on the golfer such as to be able to forcibly cause a slight twisting of a portion of the golfer's body in a down-swing start direction, and the other end connected to a drive section of the driver. The driver is adapted to cause a slight movement of the flexible member connected to its drive section in the down-swing start direction. With the flexible member caused by the driver to be moved slightly, a portion of the golfer's body with the flexible member wound thereon is moved forcibly such it is twisted in a down-swing start direction. In this way, the golfer is informed of the down-swing start timing. Particularly, with the flexible member wound on the waist, the golfer can move his or her waist in the down-swing start direction according to the movement of the flexible member. Further, the down-swing start instructor may be constructed such as to generate an impact force in the down-swing start direction. In this case, the golfer can start the down-swing in response to the impact force sensed by him or her.

A further structure of the golf swing training device according to the invention comprises the down-swing start instructor mentioned above, and arm angle detecting means, i.e., detecting means for detecting the down-swing start position. The down-swing start instructor is attached to, for instance, a belt worn around the golfer's waist. When the golfer is a right hander, the flexible member has one end attached to a belt portion corresponding to a left front portion of the waist, an intermediate portion wound from the left side to a left back portion of the body, and the other end connected to the driver which is also attached to the belt around the waist. The arm angle detecting means for detecting the down-swing start position is mounted on the golfer's arm, particularly on an upper portion thereof. The golfer sets in advance a position of the direction indicator detecting means of the arm angle detecting means such that the direction indicator detecting means detects the direction indicator when he or she comes to the top position or a position slightly therebefore in the back-swing. The golfer is informed that the indicator detecting means detected indicator by that the notifying means such as the down swing start indicating device was started when the arm reached the position immediately before the top at the time of the back swing. In response to this information, the golfer can compulsorily, intuitively and immediately slide the waist and knee on the side of the pivoting foot for several centimeters in the flying direction of the ball and then cause rotation.

Thus, the turn-over from the top to the down swing, which is most important in the golf swing, can be obtained as an ideal body turn to increase the head speed, and it becomes difficult to use the hands or arms for the down swing. Further, the backbone as an axis of rotation is made difficult to vibrate, and at the time of the start of the down swing, both of the armpits are closed naturally. Consequently, the club passes by the vicinity of the body, and the shot control (or directivity) is thus improved, thus greatly reducing misshots. Further, the club can be sharply swing through, and the weight is naturally shifted to the left foot by being pulled by the momentum of the club. Besides, a swing with the lead of the lower body can be obtained to obtain a late hit with a delay of the club head. Further, the club head hits the ball fast, and the club thus passes through before the head-up. The finish is thus determined naturally, so that it is possible to watch the hit ball continuously.

In such golf swing training device, the detecting position of the direction indicator detecting means of the arm angle detecting means may be set to a desired angular position, for instance a position at 30, 45, 60, etc. degrees from the address position, during the back-swing. When this is done so, the golfer can grasp the flying distance corresponding to the angle that is set in his or her exercise of the approach shot. Further, by setting the detecting position of the direction indicator detecting means of the arm angle detecting means such that the position corresponds to the top position angle, it is possible to make stable swing at all times with a fixed top position angle predetermined.

The golf swing training device according to the invention comprises at least that when the arm angle detecting means mounted on the arm of the golfer has detected that a prescribed arm angle is reached after the golfer has gotten into the back swing from the address, the detection is informed to the golfer via a controller by notifying means. The golfer thus can be informed by sound or speech that the golfer's shoulder is in contact with or closest to the chin in the back swing, and in response to this information the golfer intuitively and immediately causes slight sliding of the waist and knee on the side of the pivoting foot after the weight shift to the flying direction of the ball, and cause rotation of the waist and the knee. Where the down-swing start instructor is used as the informing means, it is mounted on a portion of the clothing or belt worn by the golfer so that a portion of his or her body is moved slightly in the down-swing start direction. Thus, the golfer can start the down-swing smoothly, and he or she can learn the down-swing start timing by his or her own body by repeatedly exercising the down-swing. Thus, the turn-over from the top to the down swing which is most important in the golf swing, can be obtained by an ideal body turn with the lead of the lower body, thus making it difficult to make a hand swing.

Thus, in either case both armpits are closed naturally at the time of the down swing, and consequently the club passes by the vicinity of the body. The shot control (or directivity) thus can be improved to greatly reduce misshots. Further, the club can be swung through sharply, and the weight is naturally shifted to the left foot by being pulled by the momentum of the club. Besides, it is possible to obtain a swing with the lead of the lower body and a late hit with a delay of the club head. Further, since the club head hits the ball fast, it passes through before the head-up. The finish thus is naturally completed, and the golfer can continue to watch the hit ball. Further, the golf club head speed can be increased to increase the flying distance produced by the ball. Further, even if the ball lie is somewhat inferior, the ball can be caught satisfactorily because the club head comes down with a delay.

Further, with the golf swing training device according to the invention, the arm angle to be detected by the arm angle detecting means can be set as desired. With the setting of the arm angle, as desired, the golfer can exercise stable approach shot at all times. Further, the top position can be detected by the arm angle detecting means, thus permitting stable approach shot. Further, with the golf swing training device according to the invention, the swing may be made with the same sense with any club from the approach to the driver, and there is no need of changing the swing form depending on the club used. The swing form thus can be stabilized.

BRIEF DESCRIPTION OF THE DRAWINGS

FIG. 18 is an explanatory view showing a further example of the driving device of the down swing start indicating device which is used for the golf swing training device according to the invention, FIG. 18(*a*) is a partial plane view, and FIG. 18(*b*) is a partial front view;

FIGS. 19, 20, 21, 22, 23 and 24 are partial front explanatory views showing still further examples of the driving device of the down swing start indicating device which is used for the golf swing training device according to the invention.

DETAILED DESCRIPTION OF THE INVENTION

Now, embodiments of the golf swing training device according to the invention will be described with reference to the drawings. For the sake of convenience of description, the description will be made in connection with a right hand golfer.

Figure 1:
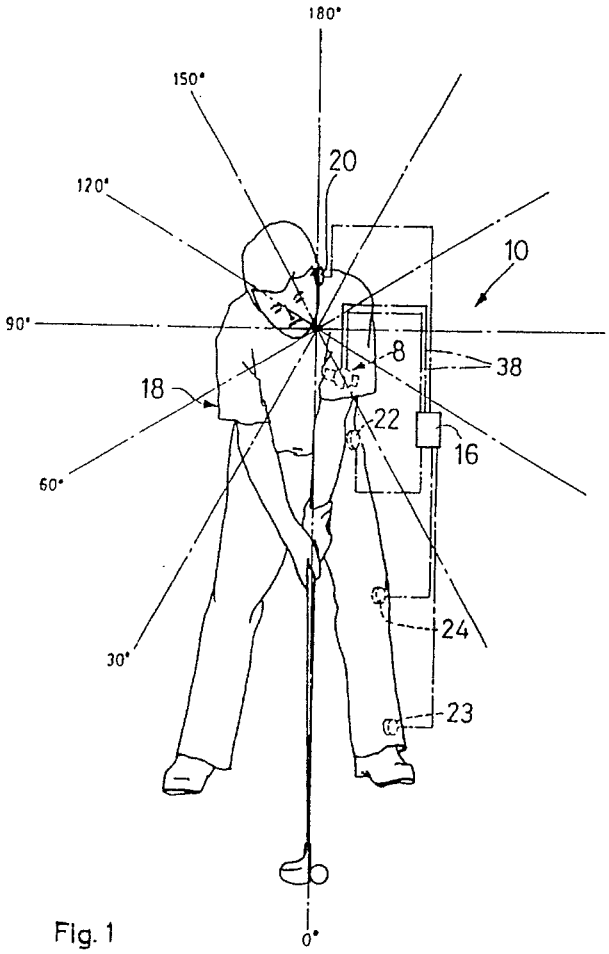
FIG. 1 is an explanatory view showing a structure of the golf swing training device according to the invention.

FIG. 1 shows a golf swing training device 10 according to the invention. As shown, the device 10 comprises an arm angle detecting means 8 mounted on the golfer's left upper arm at a predetermined position thereof, an earphone (notifying means) 20 for informing the golfer 18 of the detection by the arm angle detecting means 8 via a controller 16, to-waist transmitting means 22 for transmitting the detection to the waist of the golfer 18, and to-knee transmitting means 24 for transmitting the detection to the knee of the golfer 18.

Figure 2A:
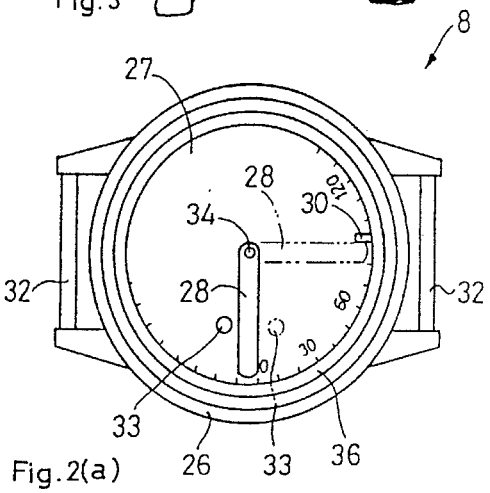
FIG. 2 is a view for showing an arm angle detecting means of the golf swing training device shown in FIG. 1, FIG. 2(*a*) is a plane view, and FIG. 2(*b*) is a front sectional view.
Figure 2B:
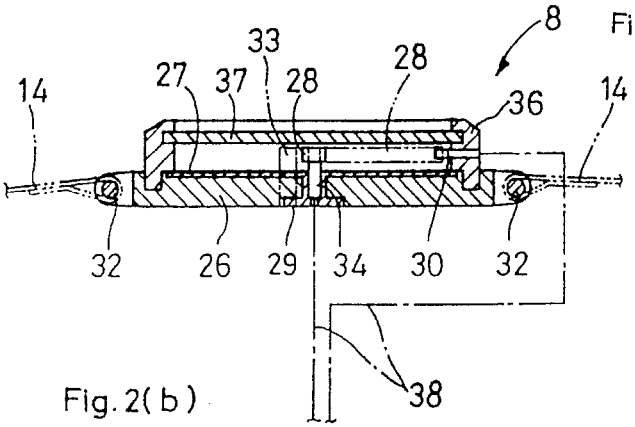

The arm angle detecting means 8, as shown in FIGS. 2 (*a*) and 2(*b*), comprises a support member 26 which is mounted on a portion of an arm of the golfer 18 for movement with that arm portion as the golfer 18 makes a swing, a direction indicator 28 which is mounted on the support member 26 and indicates the gravitational direction or a direction in a plane including the gravitational direction or a direction at a predetermined angle with respect to that direction, and a direction indicator detecting means 30 which is adapted to detect the direction indicator 28 when the support member 26 is brought to an angular position set as desired with respect to the direction indicator 28.

The support member 26 is in the form of a disc, and it has a scale member 27 rotatably mounted on its front surface. The scale member 27 has angle readings provided circumferentially at an interval of 10 degrees, 5 degrees, etc., and it can be rotated by a knob 29 provided on the back side. The support member 26 has band attachment members 32 provided on its diametrically opposite portions for attaching a band 14. It is secured to an arm of the golfer 18 by the band 14 attached to the band attachment members 32. Since the support member 26 is mounted on a portion, for instance, an upper portion of an arm of the golfer 18 by the band 14 or like member capable of elongation and contraction, that is, since the band 14 or the like extends substantially perpendicularly to the direction of the arm, the support member 26 can be mounted repeatedly substantially under the same condition. The support member 26 has a stopper 33 which projects from and is rotatable in unison with the scale member 27. Thus, the direction indicator 28 can engage with the stopper 33 to be prevented from being rotated excessively by momentum in such case as when the golfer makes a down-swing. As the stopper 33, two stoppers are suitably provided, i.e., one as shown by a solid line for a right-hander and the other as shown by a two-dot chain line for a left-hander. Either stopper 33 is adapted to be selectively projected.

The direction indicator 28 is adapted to be smoothly rotated by its own weight about a pin 34 provided on the support member 26 such as to indicate the gravitational direction. More specifically, the direction indicator 28 indicates a direction in accordance with the angle of the support member 26; it indicates the gravitational direction when the pin 34 extends in a horizontal direction, while indicating a direction in a plane including the gravitational direction when the pin 34 extends in a direction other than horizontal direction. Meanwhile, the direction indicator detecting means 30 for detecting the direction indicator 28 projects inwardly from a ring-like rotational member 36, which is mounted on the support member 26 and can be moved relative to the same in the circumferential direction. The direction indicator detecting means 30 thus can be set to an angular position as desired with respect to the support member 26 by appropriately rotating the rotatable member 36. Wiring 38 is connected to the direction indicator 28 and the direction indicator detecting means 30 such that an electric signal is produced between them when the direction indicator 28 and the direction indicator detecting means 30 are brought into contact with each other. Numeral 37 is a transparent protective plate for protecting the direction indicator 28 and other parts, and the plate is made of glass, transparent acrylic acid resin or the like.

Wiring 38 which is connected to the indicator 28 and the indicator detecting means 30 is connected to the controller 16 as shown in FIG. 1. The earphone 20, to-waist transmitting means 22 and to-knee transmitting means 24 inform the golfer 18 of the contact of the indicator 28 and the indicator detecting means 30 via a controller 16. Specifically, when the indicator 28 is detected by the contact of the indicator 28 and the indicator detecting means 30 at the time of the back swing, such a sound indicating the contact or a concrete indicative message or speech of operation is uttered through the earphone 20. The examples of the message or speech are "Start from the lower body.", "Start from the left waist.", "Start from the left knee.", "Start from the leg." "Do not move the axis.", "Do not hasten to hit the ball.", "Do not move the head.", "Just meet.", etc. It is preferable that the contents of the message or speech are composed so that they can optionally be selected by the golfer 18.

Concurrently or with a predetermined time difference, a detection signal is supplied via the controller 16 to the to-waist and to-knee transmitting means 22 and 24. As a result, the to-waist and to-knee transmitting means 22 and 24 transmit the signal to the waist and the knee to urge the operation of moving the waist and knees. The signal transmitted from the to-waist and to-knee transmitting means 22 and 24 may be a weak current, mechanical vibration, sound wave, or the like. Particularly, it is possible to use therapy equipment used for massage or like purposes.

In the golf swing training device 10 having the above structure, as shown in FIG. 1, the arm angle detecting means 8 is mounted on an upper arm portion of the golfer 18 at a predetermined position, the earphone 20 is mounted on an ear, the waist and knee transmitting means 22 and 24 are mounted on the left waist and left knee, respectively, and the controller 16 is mounted by a belt or the like on the waist or the like. The golfer 18, as shown in FIG. 1, confirms the gravitational direction indicated by the direction indicator 28 at the address position, and he or she sets a reference angle by rotating the scale member 27 such that the direction indicated by the direction indicator 28 corresponds to, for instance, zero degree on the scale member 27.

Figure 3:
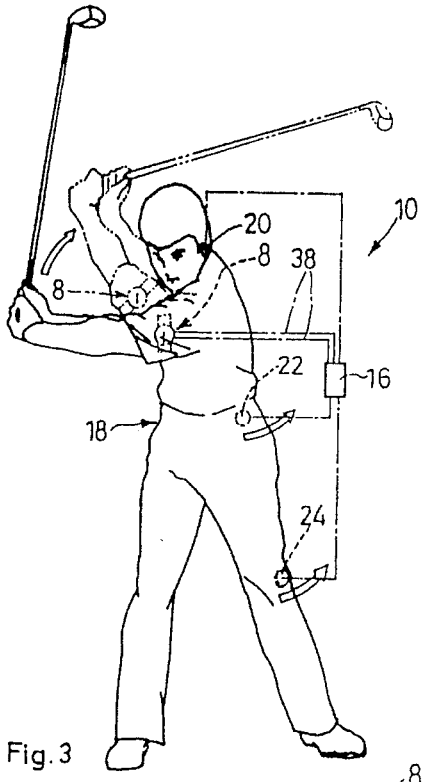
FIG. 3 is a view for explaining the operation of the golf swing training device shown in FIG. 1.
Figure 4A:
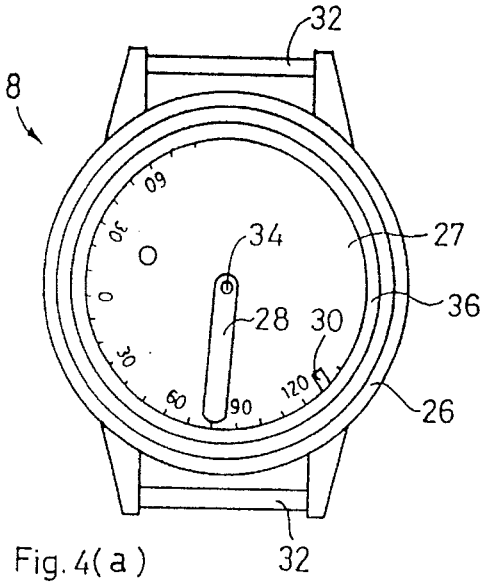
FIGS. 4(*a*) and (*b*) are plane views for explaining the operation of the arm angle detecting means of the golf swing training device shown in FIG. 3.
Figure 4B:
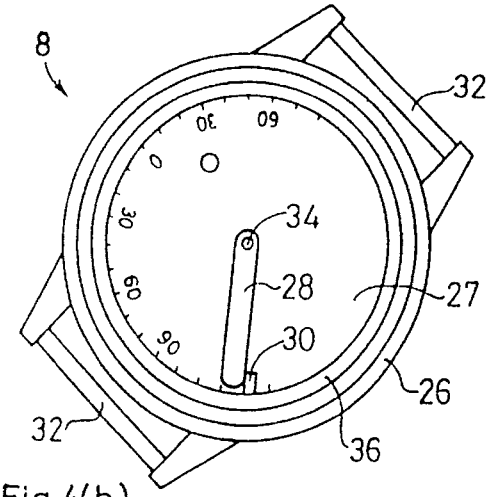

Then, as shown in FIG. 3, the golfer 18 having the golf club starts the back-swing from the address, and as he or she twists the body in the clockwise direction as shown about the backbone, the direction indicator 28 of the arm angle detecting means 8 is rotated relative to the support member 26. At the arm position as shown by a solid line in the Figure, the direction indicator 28 indicates an angle of substantially 90 degrees as shown in FIG. 4(*a*). Then, the body is further twisted, and at an arm position slightly before the top as shown by a two-dot chain line in FIG. 3, at which the movement of the left upper arm portion is substantially stopped, the position of the direction indicator detecting means 30 is set by rotating the rotational member 36 relative to the support member 26 to bring the direction indicator 28 and the direction indicator detecting means 30 into contact with each other, as shown in FIG. 4(*b*). The support member 26 can be moved in any direction in correspondence to the movement of the arm of the golfer 18, while the direction indicator 28 is rotated about the pin 34 so that it indicates the gravitational direction or a direction in a plane including the gravitational direction at all times. The direction indicator detecting means 30 can be brought into contact with the direction indicator 28 by causing rotation of the position of the direction indicator detecting means 30 relative to the support member 26.

After the above preparations, the golfer 18 can start his golf swing training as usual and gets into a back swing from the address and twists the body about the backbone in the clockwise direction. When the arm angle reached the position immediately before the top by the twisting of the body, the direction indicator detecting means 30 detects the direction indicator 28, and the detection signal causes the earphone 20 to inform the golfer 18 of one of the sounds or speeches which concretely indicate the action to take such as "Start from the lower half of body.", "Start from the left waist.", "Start from the left knee.", "Start from the leg.", "Do not move the axis.", "Do not hasten to hit the ball.", "Do not move the head.", "Just meet.", etc. These sounds or speeches are optionally selected by the golfer 18. Concurrently or with a predetermined time difference the start of action is transmitted to the waist and knees by the to-waist and to-knee transmitting means 22 and 24. Consequently, with a predetermined time difference and by a reflex, the golfer 18 intuitively and substantially slides the left waist and left knee simultaneously in the flying direction of the ball and begins turning the waist and knees in the counterclockwise direction for the down swing.

As a result, the lower body is caused to slide toward the target by several centimeters and begins to be twisted in the counterclockwise direction. At this time, the upper body is continuing to be twisted by the momentum accompanied by the back swing in the clockwise direction toward the top position. The body is thus greatly twisted. After the clockwise twisting of the upper body has been stopped by the pull of the lead of the lower body, the golfer 18 begins to be twisted in the counterclockwise direction with the muscles of the body as a spring and under the principles of the lever, thus getting into the down swing. By making this body turn swing, the golfer effects the down swing with the muscles of the body so that he or she can obtain a high head speed to hit the ball.

In the golf swing training device 10 according to the invention, it is not necessarily required to use all of the arm angle detecting means 8, controller 16, earphone 20 and to-waist and to-knee transmitting means 22 and 24. Depending on the extent of the swing level acquired as a result of training, these components may suitably be removed one after another. For example, when the golfer now can move the waist and knees at the same time, either to-waist or to-knee transmitting means 22 or 24 may be removed. Eventually, both means may be removed.

Thus, the golf swing training device 10 according to the invention eventually sufficiently be such that the arm angle detecting means 8 detects the position immediately before the top, that is to say, that the arm angle of the golfer 18 reached a predetermined angle by the contact of the direction indicator 28 and the direction indicator detecting means 30 and thus causes the earphone 20 to inform the golfer 18 of the timing of moving the waist and knees with a sound or speech via the controller 16. When the timing has been mastered after repeated exercises, the golfer now may make training without the golf swing training device 10 and may exercise actual golfing in the course. When the timing is getting out of order again, the training may be made again with the golf swing training device 10.

Now, in the above golf swing training device 10, by setting the position of the direction indicator detecting means 30 in the arm angle detecting means 8 to, for instance, 30, 45, 60, etc. degrees on the scale of the support member 26 with respect to the address position which is made to be zero degree angle position, it is possible to make stable approach shot. That is, it is possible to accurately master the flying distance produced by the approach shot at a position of 30 or 60 degrees. A stable way of approach thus can be mastered. Further, by setting the detectable position of the direction indicator detecting means 30 of the arm angle detecting means 8 such as to correspond to the top position angle, a fixed top angle can be determined to permit stable swing at all times. It is thus possible to permit swing exercise suited to individual golfers.

While a preferred embodiment of the golf swing training device has been described above, it is by no means limitative to the above embodiment. A further golf swing training device according to the invention has an object of permitting the proper body turn to be mastered by causing the left waist and the left knee to slide several centimeters in the flying direction of the ball and then being to turn at a predetermined position right before reaching the top by the golf club at the time of the back swing, and it may have any structure as long as such an object can be attained.

For example, while the above embodiment used the earphone 20 as the notifying means, it is of course possible to use a headphone in place of the earphone 20. Further, a small-size loudspeaker for generating sound or speech may be provided in the arm angle detecting means 8 or controller 16.

Another embodiment of the golf swing training device 10 according to the invention comprises arm angle detecting means 8, and/or to-waist or to-knee transmitting means 22 and/or 24 for transmitting the content that the arm has reached the position immediately before the top, as detected by the arm angle detector 8, to the waist and/or knee via the controller 16. In this embodiment, the golfer 18 suitably detect, from the sense of contact of the left shoulder and the chin with each other, the timing of causing the left waist and the left knee to slide several centimeters in the flying direction of the ball and then turn for starting the down swing. Further, it is possible to permit the timing to be detected with either one or both of the to-waist and to-knee transmitting means 22 and 24.

As shown in FIG. 1, to-ankle transmitting means 23 may be provided in order to transmit timing to start down swing to the ankle of the golfer 18 with or in place of the to-waist or to-knee transmitting means 22 and/or 24. The to-ankle transmitting means 23 comprises the same composition as the to-waist transmitting means 22 or the like.

Further, the scale member 27 may be secured to the support member 26 such that it is not rotatable relative thereto so that the reference position of the scale can not be set to be in the reference direction of the direction indicator. In this case, the angle may be with the golfer in the address as reference. The structure of the arm angle detecting means 8 thus can be simplified although some time is required for the reading of the angle and so forth.

A further example of the arm angle detecting means used in the golf swing training device according to the invention will be described, common parts being shown designated by like reference numerals and not described.

Figure 5:
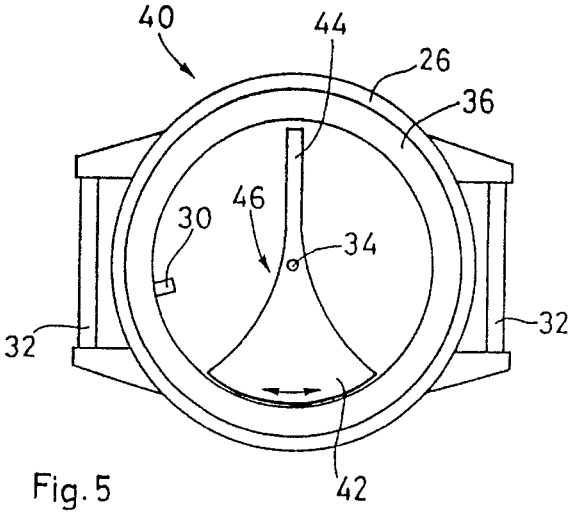
FIGS. 5, 6 and 7 are front explanatory views showing further examples of the arm angle detecting means of the golf swing training device according to the invention.

As shown in FIG. 5, the arm angle detecting means 40 of this example includes a direction indicator 46 having a weight 42 capable of being rotated smoothly by the own weight about a pin 34 provided on a support member 26 and a pointer 44 extending from the weight 42 and indicating the vertically upward direction, and a direction indicator detecting means 30 projecting inwardly from a rotatable member 36 mounted rotatably on the support member 26. The pointer 44 of the direction indicator 46 and the direction indicator detecting means 30 constitute electrodes and, like the previous example, when the pointer 44 and the direction indicator detecting means 30 are brought into contact with each other, an electric signal is produced between them, thus informing the golfer by means of speech, vibrations, etc. of the detection of the direction indicator 46. Again in this example, the detectable angle of the direction indicator 46, i.e., the angle of the arm of the golfer 18 to be detected, can be set by rotating the rotatable member 36. The direction of the pointer 44 of the direction indicator 46 is not limited to the vertically upward direction, but it may be any desired direction, and the arm angle to be detected may be made adjustable by suitably varying the angle of the pointer 44.

Figure 6:
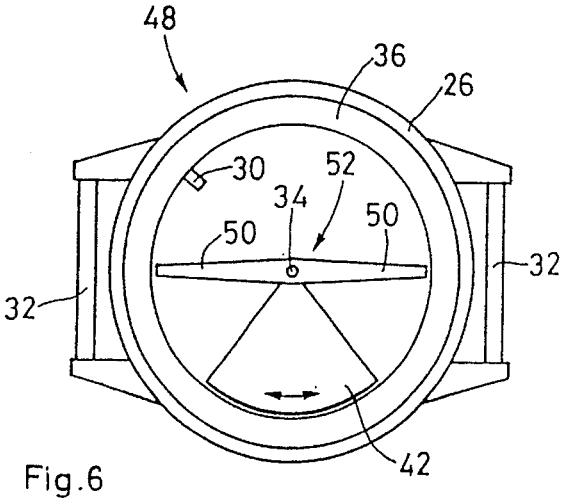

Further, as shown in FIG. 6, the arm angle detecting means 48 may include a direction indicator 52 having a weight 42 smoothly rotatable about a pin 34 provided on a support member 26 and a pointer 50 projecting substantially in a horizontal direction and capable of swinging in unison with the weight 42, and direction indicator detecting means 30 projecting inward from a rotatable member 36 rotatably mounted on the support member 26. Again in this example, the pointer 50 and direction indicator detecting means 30 constitute electrodes and have the same function as in the previous examples.

Figure 7:
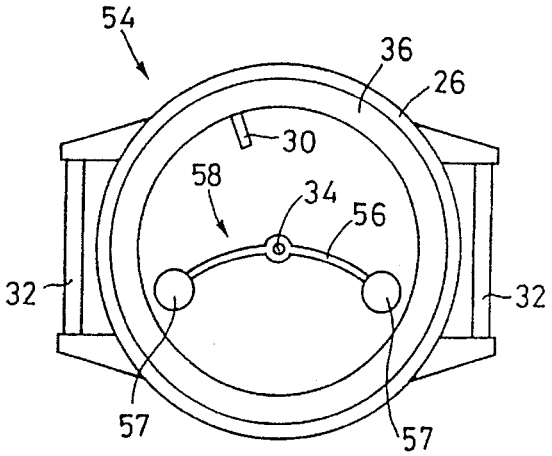

Further, as shown in FIG. 7, the arm angle detecting means 54 may include a direction indicator 58 having an arm 56 capable of swinging about a pin 34 provided on a support member 26 and a pair of weights 57 mounted on the opposite ends of the arm 56, and direction indicator detecting means 30 projecting inward from a rotatable member 36 rotatably mounted on the support member 26. The direction indicator 58 is held such that it extends in a fixed balance direction by a pair of weights 57 provided at the opposite ends of the arm 56. This balance is held when the support member 26 is moved to any angle. By utilizing this balance and also constructing the weight pair 57 of the direction indicator 58 and direction indicator detecting means 30 as electrodes, it is possible to provide the same function as in the previous examples.

Figure 8A:
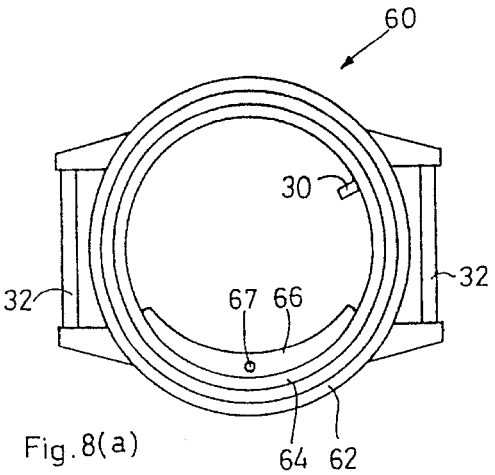
FIGS. 8 and 9 are views showing further examples of the arm angle detecting means of the golf swing training device according to the invention, FIGS. 8(*a*) and 9(*a*) are plane views, and FIGS. 8(*b*) and 9(*b*) are front sectional views.
Figure 8B:
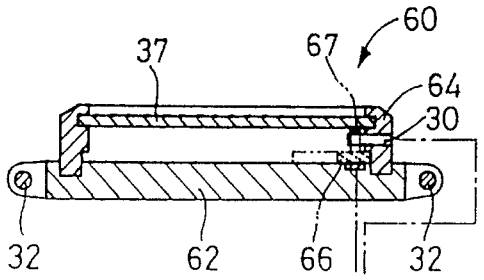

FIGS. 8(*a*) and 8(*b*) show further examples of arm angle detecting means 60. In this case, a direction indicator 66 can slide over the inner periphery of a ring-like rotational member 64 rotatably mounted on a support member 62. The direction indicator 66 has an arcuate shape and is caused to slide over the inner periphery of the rotational member 64, and its centroid direction indicates the gravitational direction. It is adapted to be stopped at a position of the minimum position energy irrespective of the rotational angle of the support member 62. Thus, when an electrode 67 provided on the direction indicator 66 and direction indicator detecting means 30 provided on the rotational member 64 are brought into contact with each other, an electric signal is produced between the two. Arm angle detecting means 60 of this structure can be operated in the same way as the previous example, and the same effect as the previous examples are also obtainable.

Figure 9A:
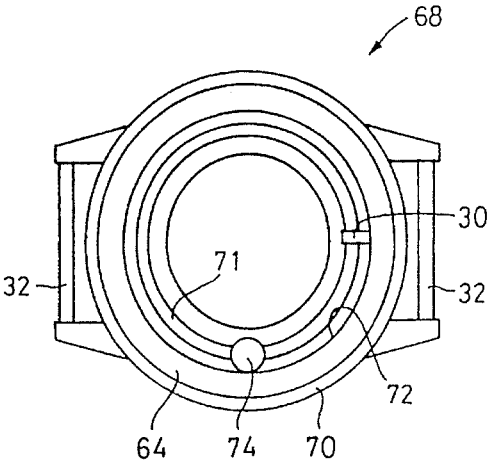
Figure 9B:
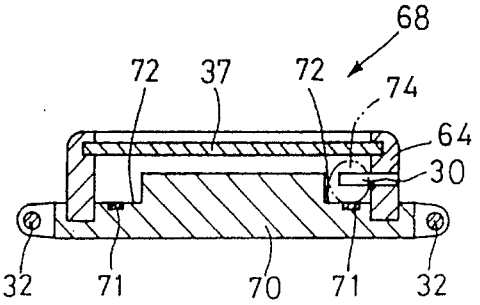
Figure 10A:
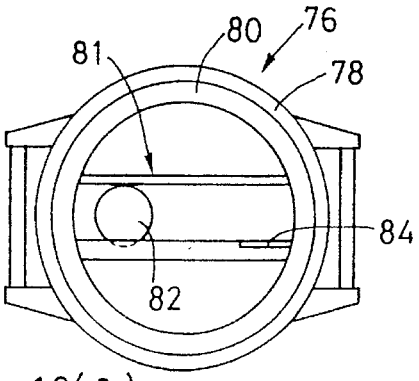
FIG. 10 is a view showing a still further example of the arm angle detecting means of the golf swing training device according to the invention, FIG. 10(*a*) is a plane view, FIG. 10(*b*) is a partial cross-sectional view, FIG. 10(*c*) is a plane view of a further example, FIG. 10(*d*) is a partial cross-sectional view of the example of FIG. 10(*c*), and FIG. 10(*e*) is a plane view of a further example.
Figure 10B:
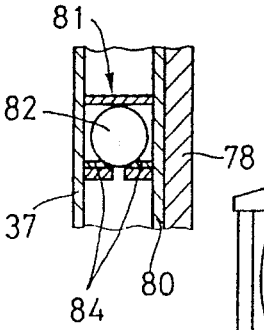
Figure 10E:
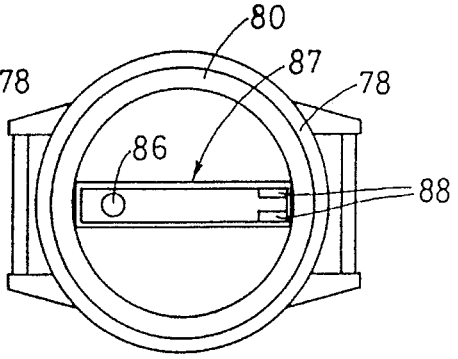
Figure 10C:
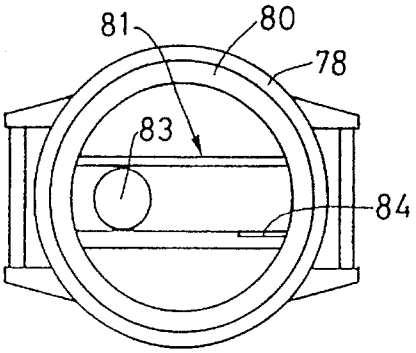
Figure 10D:
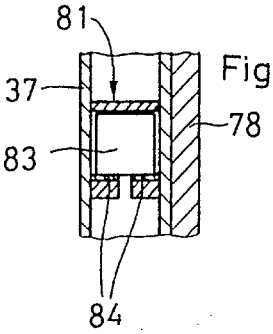

FIGS. 9(*a*) and 9(*b*) show still further examples of arm angle detecting means 68. These examples include a direction indicator 74 which is a sphere received in a circular groove 72 composed of a support member 70 and a ring-like rotational member 64. The direction indicator 74 in the form of a sphere is a good electric conductor, and a portion of the support member 70 that is to be in contact with the direction indicator 74 is constituted by a ring-like conductor 71. The direction indicator 74 is caused to undergo revolution along the circular groove 72 and tends to be stopped at a position of the minimum position energy, i.e., a position in the gravitational direction or a direction in a plane including the gravitational direction. It is thus possible to obtain the same function and effects as is with the direction indicators in the previous examples. Further, when the direction indicator 74 and direction indicator detecting means 30 provided on the rotational member 52 are brought into contact with each other, electric current is caused to flow between the conductor 71 of the support member 70 and the direction indicator detecting means 30.

FIGS. 10(*a*) and 10(*b*) show yet further examples of arm angle detecting means 76. This arm angle detecting means 76 includes a support member 78 mounted on an arm of the golfer 18, a rotational member 80 rotatably mounted on the support member 87 and capable of being fixed in an angular position which is set as desired, a spherical and conductive direction indicator 82 capable of being rolled along a guide 81 provided in the rotational member 80, and a direction indicator detecting means 84 constituted by an electrode pair formed at one end of the guide 81 of the rotational member 80. In this structure, the spherical direction indicator 82 is caused to roll along the guide 81 up to a position of the minimum position energy. Thus, when the arm angle detecting means 76 is brought together with the golfer's arm to reach an arm angle to be detected, for instance the angle of a position slightly before the top in the back-swing, the guide 81 of the rotational member 80 is tilted toward the direction indicator detecting means 84, causing the direction indicator 82 to roll up to the direction indicator detecting means 84. When the direction indicator 82 reaches the direction indicator detecting means 84 constituting a pair of electrodes, electric current is caused to flow between the two electrodes through the direction indicator 82. Thus, as described before, the informing means informs the golfer 18 of the fact that his or her arm has reached a predetermined angle. Thus, the same function as described before thus can be obtained.

Further, as shown in FIGS. 10(*c*) and 10(*d*), a cylindrical direction indicator 83 may be used in lieu of the spherical direction indicator 82. Still further, as shown in FIG. 10(*e*), a direction indicator 86 constituted by mercury may be used in lieu of the spherical rigid direction indicator 82. The mercury direction indicator 86 has such a size that its particle can be held by the surface tension to be substantially spherical in shape. It is sealed in a glass tube or like guide 87 lest its mercury should be spattered by an impact force or the like. The inner surface of the guide 87 is provided with a pair of electrodes constituting direction indicator detecting means 88. With either of these examples, the same function and effects as described before are obtainable.

Figure 11:
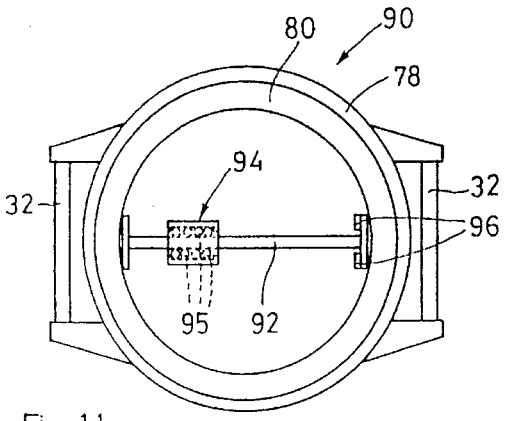
FIGS. 11, 12 and 13 are front explanatory views showing still further examples of the arm angle detecting means of the golf swing training device according to the invention.

FIG. 11 shows a further example of arm angle detecting means 90. As shown, this arm angle detecting means 90 includes a support member 78, a rotational member 80 which is rotatably mounted on the support member 78, a ring-like conductive direction indicator 94 capable of sliding along a guide rod 92 provided in the rotational member 80, and direction indicator detecting means 96 constituted by an electrode pair formed at one end of the guide rod 92 of the rotational member 80. Again in this structure, as described in the example of FIG. 10, the direction indicator 94 slides along the guide rod 92 to the minimum position energy position. Thus, the same function and effects as described above can be obtained. Suitably, bearings 95 are provided within the direction indicator 94 to permit smooth sliding thereof.

Figure 12:
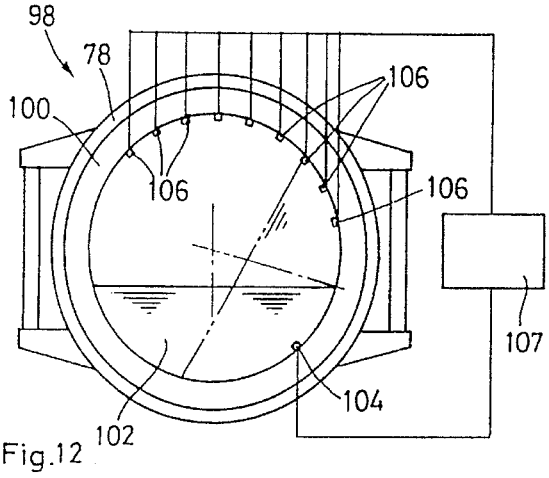

FIG. 12 shows a further example of arm angle detecting means 98. This arm angle detecting means 98 includes a support member 78, a hollow disc-like rotational member 100 rotatably supported on the support member 78, and a predetermined amount of mercury or like conductive fluid 102 accommodated in the hollow rotational member 100. The hollow rotational member 100 has a common electrode 104 and one or more discrete electrodes 106 provided at a predetermined angular interval to the common electrode 104. In this example, the conductive fluid 102 serves as a direction indicator for indicating a horizontal direction at all times. With the rotation of the rotational member 100 together with the support member 78, the conductive fluid 102 connects the common electrode 104 to one or more discrete electrodes 106, whereby the arm angle can be detected from a current value or a connected position obtained from a controller 107 or the like.

Figure 13:
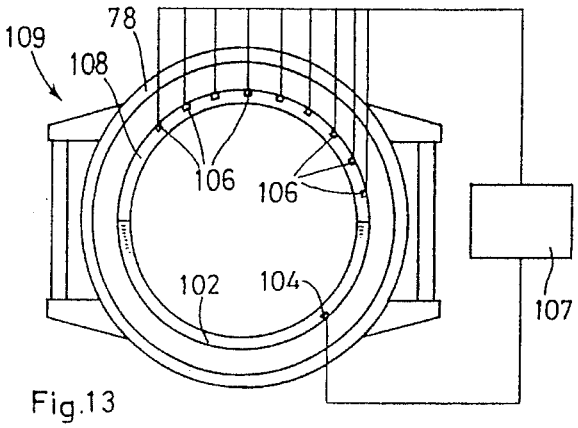

FIG. 13 shows a modification of the above example. This structure of arm angle detecting means 109 includes a hollow rotational member 108 having a ring-like cylindrical hollow inner space accommodating a predetermined quantity of conductive fluid 102. This structure permits reduction of the quantity of conductive fluid 102 used. In addition, the fluid 102 does not produce waves but is stable.

Figure 14A:
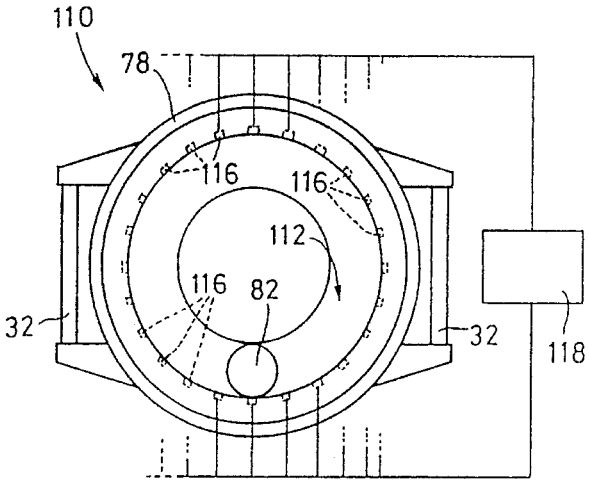
FIG. 14 is a view showing a still further example of the arm angle detecting means of the golf swing training device according to the invention, FIG. 14(*a*) is a plane view, and FIG. 14(*b*) is a partial cross-sectional view.
Figure 14B:
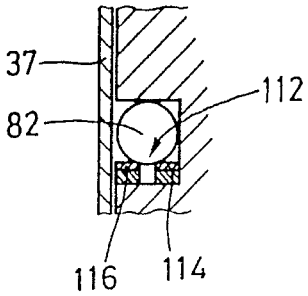

FIGS. 14(*a*) and 14(*b*) show further examples of arm angle detecting means 110. This arm angle detecting means 110 includes a support member 78 having a ring-like guide groove 112, and a spherical or cylindrical direction indicator 82 made of a conductive material and adapted to roll along the guide groove 112. The surface of the guide groove 112 along which the direction indicator 82 rolls is provided with a common electrode 114 and a number of discrete electrodes 116 disposed at a predetermined angular interval to the common electrode 114. Further, position storage/display means 118 is provided, which is adapted such that when the common electrode 114 and a particular one of the discrete electrodes 116 are electrically connected to each other by the direction indicator 82, it detects, stores and displays the position of the particular discrete electrode 116. With this structure, the golfer has a particular discrete electrode 116 corresponding to the address position memorized in advance, and then he or she has the discrete electrodes 116 passed by in a back-swing be memorized successively. Now, the golfer has the storage of a particular discrete electrode 116 corresponding to the top position and detects the angle of the top from the position of each of the discrete electrodes 116. Alternatively, it is possible to detect only the position of the particular discrete electrode 116 corresponding to the top position so as to store and, if necessary, display that position. Further, at the top position it is possible to set a position slightly before the top position as the position of the direction indicator 82 to be detected. Further, it is possible to set a discrete electrode 116 at a predetermined angular position with respect to the particular electrode 116 corresponding to the address position as the position of the direction indicator 82 to be detected.

Figure 15A:
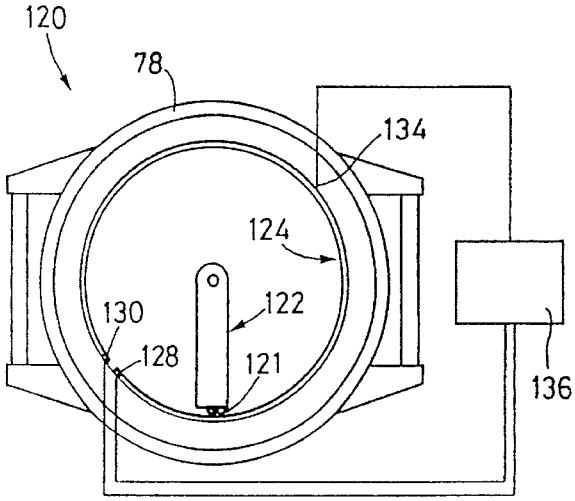
FIG. 15 is a view showing a still further example of the arm angle detecting means of the golf swing training device according to the invention, FIG. 15(*a*) is a plane view, and FIG. 15(*b*) is an explanatory view showing a light sensor which is spread out.
Figure 15B:
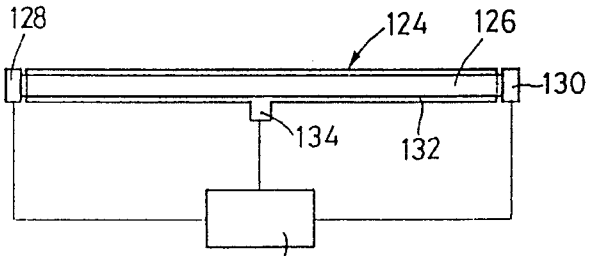

FIGS. 15(*a*) and 15(*b*) show further examples of arm angle detecting means 120. This arm angle detecting means 120 includes a support member 78, a direction indicator 122 rotatably provided on the support member 78 at the center thereof and having a spot light source 121 having directivity, and a light sensor 124 having linearity and concentric with the center of rotation of the direction indicator 122. The light sensor 124 has a light incidence side upper electrode 126 with output electrodes 128 and 130 provided at diametrically opposite ends and a lower electrode 132 provided with a con, non output electrode 134. Light is projected downward from the spot light source 121 of the direction indicator 122. When light is incident on the light sensor 124, an electromotive force is generated in the light incidence portion of the light sensor 124, thus causing a current between the output electrode pair 128, 130 and common output electrode 134. If the illumination intensity of light from the spot light source 121 is constant, the electromotive force generated in the light sensor 124 is constant. Generally, however, the upper electrode 126 as a transparent electrode is highly resistive, and a voltage drop is produced depending on the distance between the electromotive force generation position and the output electrode pair 128, 130. This may be utilized to detect the light projection position using a controller 136 or the like. With the arm angle detecting means 120, the arm angle can be detected by real time detection. A golf swing training device thus can be constructed by setting the controller 136 such that a speech or signal is generated upon detection of a predetermined angle.

As has been shown, the arm angle detecting means of the golf swing training device according to the invention may have various structures. Particularly, it is most suitable in view of the cost that the direction indicator is adapted to indicate the gravitational direction or a direction in a plane including the gravitational direction at all times. Further, it is possible to use a gyroscope or like means for indicating a fixed direction at all times for detecting the angle between this means and the support member, i.e., a golfer's arm. Such a structure may also be adapted to be able to inform the player of a detected position slightly before the top.

Further, in addition to the above basic structure, the golf swing training device according to the invention may include means for detecting the speed or acceleration of the golf club or means for detecting a shift of the golfer's weight, or it may include, in combination with these means, judging means for determining whether or not the swing form is good.

Further, the arm angle detecting means 8, informing means such as the earphone 20, and to-waist and to-knee transmitting means 22 and 24 as described above may be adapted to transmit information via radio waves as well as wire leads. Further, the position of mounting of the arm angle detecting means 8, etc. is not limited to an upper arm portion of the golfer 18; for instance, it may be mounted on a wrist or like portion as well.

Further, the informing means of the golf swing training device according to the invention may be constructed as a down-swing start instructor, which can forcibly move a portion of the golfer's body in a down-swing start direction or give an impact to the golfer's body portion, as well as means for informing by speech or vibrations.

Figure 16:
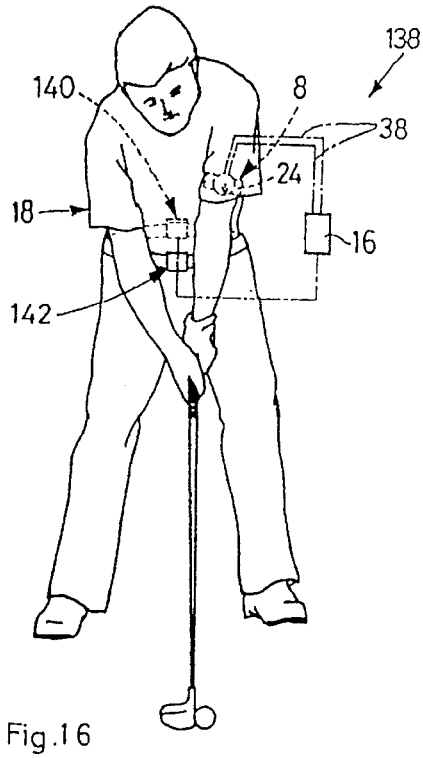
FIG. 16 is an explanatory view showing a further example of the golf swing training device according to the invention.

FIG. 16 shows an example of golf swing training device 138 according to the invention, which comprises the arm angle detecting means 8 shown in FIG. 2 which is mounted on the left upper arm portion at a desired position thereof and a down-swing start instructor 140, which informs the golfer 18 via a controller 16 of the detection detected by the arm angle detection means 8. The arm angle detecting means 8 has already been described, and it is not described here.

Figure 17A:
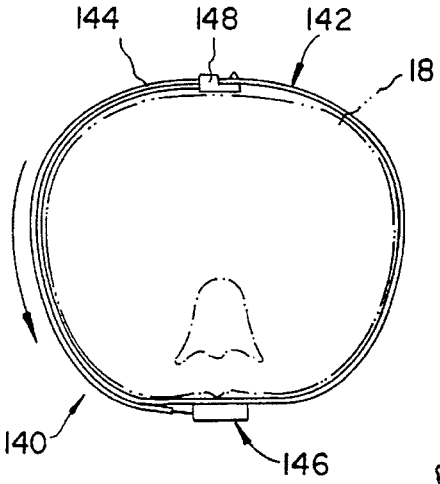
FIG. 17 is an explanatory view showing a structure of a down swing start indicating device which is used for the golf swing training device shown in FIG. 16, FIG. 17(*a*) is a plane view, FIG. 17(*b*) is a partial explanatory view of the driving device, and FIG. 17(*c*) is a partial explanatory view showing a fixed part of the belt.
Figure 17B:
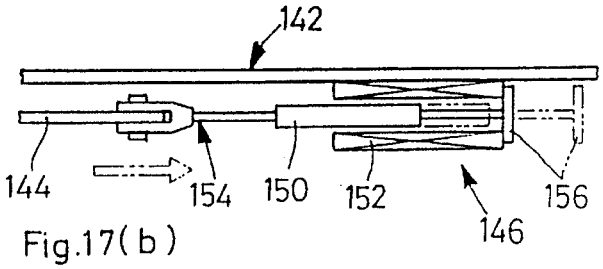
Figure 17C:
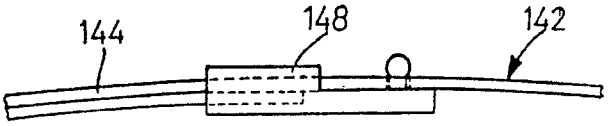

The down-swing start instructor 140 is shown in FIGS. 17(*a*) to 17(*c*). As shown, it includes a flexible member 144 which is made integral with a belt 142 for securing the golfer 18's clothing, and a driver 146 for causing a slight movement of the flexible member 144. The belt 142 has one end secured to, for instance, a buckle 148 as shown in FIG. 17(*c*), and it is turned by one turn around the waist of the golfer 18. Its other end is secured by the engagement between a hole formed in it and a projection of the buckle 148. The other end of the belt 142 has an extension, which constitutes the flexible member 144. As shown in FIG. 17(*a*), the flexible member 144 is wound from the left belly portion to the left side and thence to the left back portion, and its end is connected to the driver 146 which is secured to the belt 142 around the back.

The driver 146 of the down-swing start instructor 140, as shown in FIG. 17(*b*), is constructed of a solenoid including a movable iron core 150 and a coil 152 for magnetizing the core 150. The driver 146 further includes a coupling member 154 coupling the end of the flexible member 144 and the movable iron core 150, and a stopper 156 for preventing the movable core 150 from being detached from the coil 152. The coil 152 is excited by current supplied from the controller 16 according to a detection signal from the arm angle detecting means 8. When the coil 152 is excited, the movable iron core 150 is momentarily pulled toward the center of the coil 152, thus pulling the flexible member 144 via the coupling member 154. Since the other end of the flexible member 144 being pulled is secured to the buckle 148 of the belt 142, the waist of the golfer 18 on the side with the flexible member 144 wound thereon is moved such that it is slightly twisted. The direction of the twist of the waist is the down-swing start direction. The golfer thus can smoothly twist the waist as soon as the flexible member 144 is moved.

With the golf swing training device 138 having the above construction, as shown in FIG. 16, the arm angle detecting means 8 is mounted on the upper arm portion of the golfer 18 at a predetermined position, the down-swing start instructor 140 is mounted on the waist such that it is integral with the belt 142, and the controller 16 is mounted on a non-driven portion of the belt 142 or the like. The golfer 18 then adjusts the arm angle detecting means 8 in the manner as described before in connection with FIGS. 1 to 4.

Thereafter, the golfer 18 can exercise the golf swing as usual as described before. First, the golfer 18 makes a back-swing from the address. At this time, he or she twists the body clockwise about the backbone. At a position slightly before the top, the direction indicator detecting means 30 detects the direction indicator 28, and generates a detection signal which causes a current to flow from the controller 16 to the down-swing start instructor 140 substantially simultaneously or after a slight time delay. As a result, the coil 152 of the driver 146 is excited, thus causing the movable iron core 150 to be moved momentarily. The waist of the flexible member 144 is thus pulled toward the movable core 150 to cause twist of the waist of the golfer 18 in the down-swing start direction. Thus, with the sense of reaction the golfer 18 starts to cause the left waist and left knee to slide in the ball flying direction and be turned counterclockwise substantially simultaneously. As a result, the function and effects as described above can be obtained.

While various embodiments of the golf swing detecting device according to the invention have been described, the down-swing start instructor as described above, which is used for such golf swing training devices, are by no means limitative, and various other examples are possible.

An example driver 158 shown in FIG. 18, is constructed with a motor 160 and a take-up drum 162 driven thereby, and a rope 164 connected to the end of flexible member 144 and to be taken up on the take-up drum 142. With this driver 158, the flexible member 144 is pulled in the manner as described when the rope 164 is taken up on the take-up drum 162 with the driving of the motor 160 caused according to a detection signal from arm angle detecting means 8. Suitably, the motor 160 is adapted to be driven for a predetermined period of time. Alternatively, it is adapted that the motor 160 is stopped or a clutch is decoupled when a fixed load is applied to the motor 160.

An example of driver 166 shown in FIG. 19, includes a motor 160, a rotational disc 168 to be driven thereby for one rotation, and a pin 169 projecting from the rotational disc 168 at a position thereof eccentric to the center of rotation, a hole provided in an end of flexible member 144 being engaged on the pin 169. With this driver 166, the flexible member 144 is pulled utmost when the rotational disc 168 driven by the motor 160 has undergone one half rotation, and then it is returned to the initial position.

An example of driver 166 as shown in FIG. 20, has the same structure as shown in FIG. 19 except that the end of the flexible member 144 to be engaged with the pin 169 has an elongate hole 170. While in the example shown in FIG. 19 the flexible member 144 is caused to swing in the perpendicular direction to the longitudinal direction of the flexible member 144 with the rotation of the rotational disc 168, in this example the flexible member 144 is moved in the longitudinal direction only.

FIGS. 21 to 23 show further examples. The example of driver 172 shown in FIG. 21 includes an arm 174 and rotational drive means 176 such as a motor for causing rotation of the arm 174 by a predetermined angle only. The example of driver 178 shown in FIG. 22 includes an electromagnet 180 and an attractable member 182 to be attracted to the electromagnet 180. The example of driver 184 shown in FIG. 23 includes a pressure source 186 for supplying hydraulic or pneumatic pressure, a cylinder 188 furnished with hydraulic or pneumatic pressure from the pressure source 186, and a piston 190 to be driven hydraulically or pneumatically. With either of these examples, the same function and effects as in the previous examples are obtainable. It is possible to construct the driver having any structure so long as the flexible member is pulled in the longitudinal direction; for instance, it is possible to utilize shape storage alloys. Although not shown, the driving section of each driver described above is suitably provided with a protective cover for the sake of safety.

FIG. 24 shows a further structure of down-swing start instructor 192. This down-swing instructor 192 includes a cylindrical electromagnet 194, an impact providing member having a rod 198 which can be moved through the electromagnet 194 and provided at one end with a coil attachment plate 196 and at the other end with an impact providing plate 197, and a compression coil spring 200 biasing the coil attachment plate 196 away from the electromagnet 194. This down-swing start instructor 192 is disposed on a portion of belt 142 in the neighborhood of the left waist portion of the golfer. In this down-swing start instructor 192, the electromagnet 194 is held excited in advance, and the coil attachment plate 196 is attached to the electromagnet 194 by pushing it against the biasing force of the compression coil 200. In this state, a detection signal produced from the arm angle detecting means causes the electromagnet 194 to be de-excited momentarily, thus causing the rod 198 of the impact providing member to be pushed out by the biasing force of the compression coil 200 to cause the impact providing plate 197 to strike the other end of the electromagnet 194 so as to provide an impact force in the down-swing start direction. By sensing this impact force, the golfer 18 starts the down-swing.

It is possible to use a tension spring in lieu of the compression spring 200 in this example. Further, it is possible to cause start of the rod 198 momentarily with an electromagnetic solenoid or the like. Further, it is possible to adopt any other structure as well to obtain the impact force. In this example, no flexible member is necessary.

While various examples of the driver of the down-swing start instructor have been shown and described, it is possible to mount such drivers not only on the belt 142 worn on the waist of the golfer 18 but also on the clothing thereof, such as a vest or a trouser. Further, while the flexible member to be driven slightly in the down-swing start direction by the driver has been shown to be made integral with the belt 142, this is by no means limitative. For example, it may be adapted to be wound on a portion of the golfer's body such as to be able to forcibly cause a slight twist of the golfer's body in the down-swing start direction. It may be in the form of a string or a strip. Its end to be mounted on the golfer's clothing may be sewn to a part of the clothing or detachably attached to the same by means of a clip.

The arm angle detecting means 8 which can serve as means for detecting the down-swing start position, may have various structures as exemplified above.

While the above description of the golf swing training device according to the invention has assumed a right-hander, it is of course possible to construct the device for a left-hander. In this case, it is of course that the left and right are reversed in the above description.

With a specific form of the golf swing training device according to the invention, when the golfer's arm angle reaches an angle at a position which is set as desired in the back-swing from the address to the top, the golfer can be informed of by speech from an earphone or a small-size loudspeaker provided in the neighborhood of an ear the basic action and/or points of the golf swing to be noted specifically. It is possible that the basic actions and points of the golf swing to be noted specifically are input to and stored in storage means, such as an IC or a magnetic tape, to be selectively reproduced by turning on a switch. The golf swing may be trained with such speech or artificial speech. Although the basic actions and points to be noted of the golf swing are very important, they may be forgotten as the golfer masters the golf swing, and the golfer is liable to make golf swing in his or her own way. Accordingly, a series of basic actions and points to be noted while the golfer makes a back-swing from the address to the top are given to him or her by speech or artificial speech in his or her training of the golf swing. The timings at which the golfer is informed of the basic actions and points to be noted of the golf swing, are set adequately during the back-swing from the address to the top such that the golfer can correct the swing form. By using such a golf swing training device, the golfer can confirm the basic actions at all times and acquire stable swing form.

For the storage means may be used any memory, such as magnetic tapes, microfilms, ROM or RAM using IC, etc. The contents of the basic actions, etc. to be stored in the storage means may be such that contents which can be informed during one swing can be selected in correspondence to the golfer's level of play.

Further, the controller suitably includes a battery or an amplifier for the above operation, and for example, solar cells may be used as a battery. To-waist and to-knee transmitting means are suitably capable of being removably bonded to predetermined positions using double side adhesive tapes or double side fasteners. Further, the notifying means is not limited to the above examples, and can be suitably composed of the one which gives a shock to the waist of the golfer, and the like. Further, it is possible to suitably combine the above embodiments. Further, various changes and modifications of the embodiments of the invention may be made without departing from the scope and spirit of the invention and on the basis of the knowledge of a person having ordinary knowledge in the art.

What is claimed is:

1. A golf swing training device comprising upper arm angle detecting means mounted on a golfer's upper arm for movement therewith as the golfer makes a swing, thereby detecting the angle of the upper arm, and informing means for informing the golfer of the upper arm angle detected by the upper arm angle detecting means.

2. The golf swing training device according to claim 1, wherein the upper arm angle detecting means includes a direction indicator mounted on the golfer's upper arm and for indicating a predetermined absolute axis direction, and direction indicator detecting means for detecting the direction indicator upon reaching of an angular position set as desired with respect to the direction indicator.

3. The golf swing training device according to claim 1, wherein the upper arm angle detecting means includes a support member mounted on the golfer's upper arm for movement therewith as the golfer makes a swing, a direction indicator mounted on the support member and for indicating a direction in a plane including the gravitational direction or a direction at a fixed angle to the afore-mentioned direction, and direction indicator detecting means for detecting the direction indicator when an angular position set as desired with respect to the direction indicator is reached by the support member.

4. The golf swing training device according to claim 1, wherein the upper arm angle detecting means includes a support member mounted on the golfer's upper arm for movement therewith as the golfer makes a swing, a rotatable member mounted rotatably on the support member and capable of being fixed at an angular position set as desired, a direction indicator capable of being moved along a guide provided on the rotatable member to a position corresponding to minimum position energy, and direction indicator detecting means provided on the guide of the rotatable member and for detecting the direction indicator when an angular position set as desired is reached by the support member.

5. The golf swing training device according to claim 1, wherein the upper arm angle detecting means includes a support member mounted on the golfer's upper arm for movement therewith as the golfer makes a swing, a direction indicator for indicating a horizontal direction at all times, and a direction indicator detecting means for detecting the direction indicator when an angular position set as desired with respect to the direction indicator is reached by the support member.

6. The golf swing training device according to any one of claims 1 to 5, wherein the informing means for informing the golfer is by pre-recorded speech of instructions of operation selectively activated by said angle detecting means, such as "Start from the lower half of body,", "Start from the waist,", "Start from the knee,", "Start from the legs,", "Do not move the axis,", "Do not hasten to hit the ball,", "Do not move the head,", "Just meet,".

7. The golf swing training device according to claim 6, wherein the upper direction indicator detecting means of the arm angle detecting means is set such as to detect a golfer's upper arm angle corresponding to the top position or a position slightly before reaching the top position in the back-swing, the informing means informing the golfer of an instruction to start the down-swing from the lower half of the body when the aforementioned position is detected.

8. The golf swing training device according to claim 6, wherein the upper arm angle detecting means is set such as to detect an angle set as desired during the back-swing from the address to the top position, the top angle position being determined or the approach swing being started according to an instruction from the informing means when the aforementioned angle is detected as a fixed angle.

9. The golf swing training device according to one of claims 1 to 5, wherein the informing means includes transmitting means to transmit start timing by giving mechanical or electrical vibration or stimulation onto the knee and/or the waist on the side of the support foot after body weight shift.

10. The golf swing training device according to claim 9, wherein the direction indicator detecting means of the upper arm angle detecting means is set such as to detect a golfer's upper arm angle corresponding to the top position or a position slightly before reaching the top position in the back-swing, the informing means informing the golfer of an instruction to start the down-swing from the lower half of the body when the aforementioned position is detected.

11. The golf swing training device according to claim 9, wherein the upper arm angle detecting means is set such as to detect an angle set as desired during the back-swing from the address to the top position, the top angle position being determined or the approach swing being started according to an instruction from the informing means when the aforementioned angle is detected as a fixed angle.

12. The golf swing training device according to one of claims 1 to 5, wherein the informing means is a down-swing start instructor provided on a portion of clothing or belt worn by the golfer and for forcibly causing a slight twisting of a portion of the golfer's body in a down-swing start direction or giving a shock on the golfer's body.

13. The golf swing training device according to claim 12, wherein the direction indicator detecting means of the upper arm angle detecting means is set such as to detect a golfer's upper arm angle corresponding to the top position or a position slightly before reaching the top position in the back-swing, the informing means informing the golfer of an instruction to start the down-swing from the lower half of the body when the aforementioned position is detected.

14. The golf swing training device according to claim 12, wherein the upper arm angle detecting means is set such as to detect an angle set as desired during the back-swing from the address to the top position, the top angle position being determined or the approach swing being started according to an instruction from the informing means when the aforementioned angle is detected as a fixed angle.

15. The golf swing training device according to one of claims 1 to 5, wherein the direction indicator detecting means of the upper arm angle detecting means is set such as to detect a golfer's upper arm angle corresponding to the top position or a position slightly before reaching the top position in the back-swing, the informing means informing the golfer of an instruction to start the down-swing from the lower half of the body when the afore-mentioned position is detected.

16. The golf swing training device according to one of claims 1 to 5, wherein the upper arm angle detecting means is set such as to detect an angle set as desired during the back-swing from the address to the top position, the top angle position being determined or the approach swing being started according to an instruction from the informing means when the afore-mentioned angle is detected as a fixed angle.

17. A golf swing training device comprising a down-swing start instructor including a flexible member mounted on a portion of clothing or belt worn by the golfer and for forcibly causing a slight twisting of a portion of the golfer's body in a down-swing start direction and a driver for causing a slight movement of the flexible member in the down-swing start direction, position detecting means for detecting a down-swing start position; and a controller for transmitting a detection signal from the position detecting means to the down-swing start instructor.

* * * * *